United States Patent [19]

Kuchler

[11] 4,338,836

[45] Jul. 13, 1982

[54] SLICING MACHINE WITH SLICE-DEPOSITING DEVICE

[75] Inventor: Fritz Kuchler, Klagenfurt, Austria

[73] Assignee: Brain Dust Patents Establishment, Vadux, Liechtenstein

[21] Appl. No.: 191,011

[22] Filed: Sep. 26, 1980

[30] Foreign Application Priority Data

Sep. 27, 1979 [AT] Austria ..... 6354/79

[51] Int. Cl.[3] ..... B26D 7/00

[52] U.S. Cl. ..... 83/94; 83/154; 83/161; 271/18.3; 414/69; 414/908

[58] Field of Search ..... 83/78, 94–96, 83/154, 161; 414/69, 908; 271/18.3

[56] References Cited

U.S. PATENT DOCUMENTS

| | | | |
|---|---|---|---|
| 1,976,865 | 10/1934 | VanBerkel | 83/96 |
| 2,274,626 | 2/1942 | VanBerkel | 83/96 |
| 3,176,979 | 4/1965 | Engelmann | 271/18.3 |
| 3,386,763 | 6/1968 | Ottaway et al. | 271/18.3 X |
| 3,831,778 | 8/1974 | Biber | 271/18.3 X |
| 3,958,475 | 5/1976 | Zapgmel | 83/95 X |

*Primary Examiner*—James M. Meister

*Attorney, Agent, or Firm*—Montague & Ross

[57] ABSTRACT

A cutting machine, especially for foodstuffs such as wurst, forms slices of the product which are picked up on a cylindrical drum which has retractable pins and which, upon take-up of the slices, deposits them upon a plate by swinging downwardly toward the latter. The pins are retracted by the downward swinging movement to release the slices.

7 Claims, 8 Drawing Figures

FIG.5
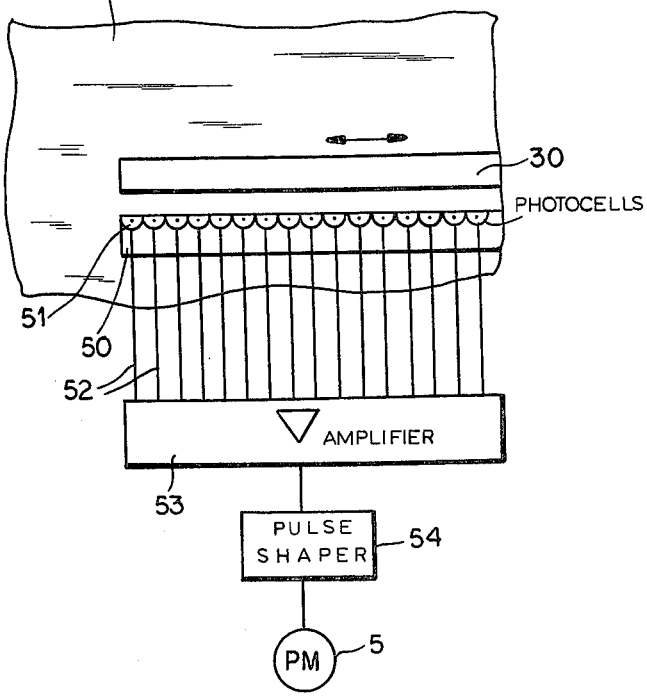
FIG.6
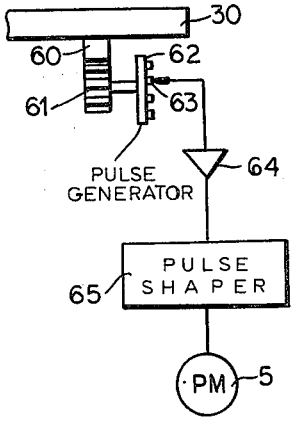
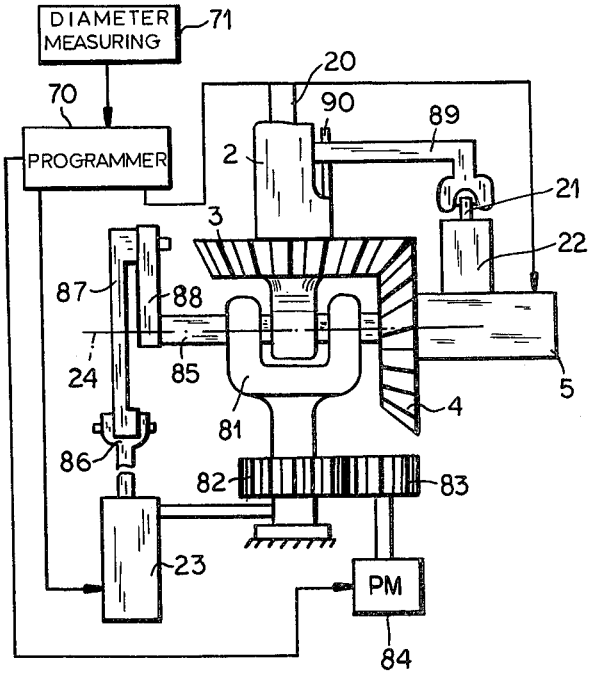
FIG.8
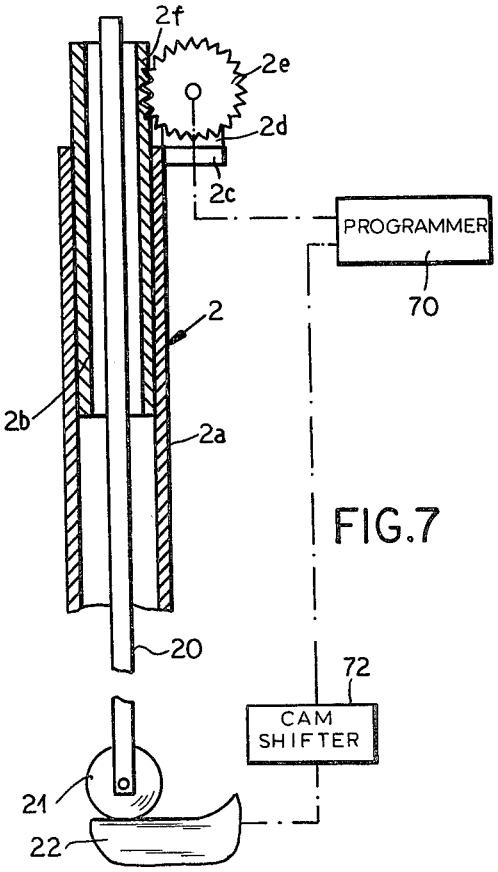
FIG.7

SLICING MACHINE WITH SLICE-DEPOSITING DEVICE

FIELD OF THE INVENTION

My present invention relates to a slice-depositing device for a slicing machine or, more generally, to a device for laying down upon a receiving table or plate, or positioning on such a table, a succession of cut objects, for example, wurst slices, which are severed by a cutting machine from a larger mass of the product.

BACKGROUND OF THE INVENTION

Slicing machines for wurst and other comestible masses generally comprise a table receiving the object to be sliced and a rotary blade or disk which lies in a vertical or substantially vertical plane and against which the mass is urged as the mass is drawn across a cutting edge. Slices of the product fall to a table on the opposite side of the blade, generally after passing through a gap between a positioning wall or plate against which the face of the mass to be cut is pressed. As the table is reciprocated horizontally, successive slices are cut from the mass.

It frequently is desirable to collect the slices in a different manner or at a location spaced from immediately below the slicer, or to position the slices in a particular pattern, order or array, especially for packaging and the like. In such cases, the slicer, consisting of the reciprocable carriage, the circular blade and the abutment plate, is used in association with a depositing table, plate or platform upon which the slices are collected.

It is known, for example, to provide a depositing or positioning device which has a frame juxtaposed with the circular blade and a number of chains carrying pins which impale the slice as it is cut by the blade. The slices are generally fed by a feed roller to the pins of the chains whence they are carried to the desired location and deposited upon the platform, table or plate by a stripper which draws the slice of the pins and casts the slice.

There are other systems known which use, in place of the chain arrangement, a swingable rake or comb which impales the slices on the points or pins. This device is swung into a take-up position adjacent the blade and then into a depositing position in which the slice is cast from the pins onto the table in a manner analogous to that which is previously described.

Difficulties have been encountered with both devices with respect to take-up of the slices and the removal of the slices from the transfer device. In general, these problems arise because of relative movement of the pins and the slice during the cutting operation and result in distortion, tearing or other damage to the slice. The stripping of the slice from the pins by the above-described conventional approaches also has been found to cause damage.

In order to avoid the relative movement mentioned previously, it has been proposed to provide the take-up body as a conical rotary member which is swingable relative to the receiving plate and which is provided over a part of its conical surfce with pins which are retractable upon rotation of the body. While this device solves some of the problems mentioned previously, it is of complicated construction and frequently is unreliable. In addition, the device is expensive and requires considerable maintenance and adjustment.

OBJECTS OF THE INVENTION

It is, therefore, the principal object of the present invention to provide an improved transfer device for taking up cut products from a cutting machine, especially a food-slicing machine, and depositing these slices upon a receiving table.

Another object of the invention is to provide a slicing machine, especially for wurst and like comestible bodies, with improved transfer of the slices to a receiving table and nevertheless which is free from the disadvantages of the prior art systems mentioned above.

It is another object of the invention to provide a simplified and reliable slice-transfer mechanism capable of taking up a slice from a food slicer in an upright position and delivering the slice to a table with a minimum of distortion or damage to the slice.

SUMMARY OF THE INVENTION

These objects and others which will become apparent hereinafter are attained, in accordance with the present invention, in a food-slicing machine having the usual abutment plate against which the body of wurst or the like is pressed, a carriage extending transversely to the plate and horizontally reciprocatable relative thereto, and a circular blade lying in general in an upright plane and rotatable to sever a slice from the comestible body, the machine being provided with a transfer device for taking up the slice as it is cut from the body adjacent the blade and depositing the slice upon a generally horizontal table.

According to the invention, the take-up device comprises a cylindrical rotary member or drum which is formed over its entire cylindrical surface with an array of retractable pins or needles engageable in their extended positions, with the slice and adapted to be withdrawn inwardly of the surface of the drum to release the slice.

The principal advantage of the device of the present invention is that the rotatable cylindrical drum unites in a single member the numerous functions hitherto requiring a variety of moving parts in earlier systems. For example, the pins or needles in their extended positions lie directly adjacent the blade so that they rotate into engagement with the slice which lies tangentially to the drum. Since the rotary speed (peripheral speed) of the drum can be equal to the linear speed of the emerging slice, there is no tearing or distortion of the slice.

When the slice rotates on the drum into a position 180° offset from the take-up position, the drum can be tilted downwardly to overlie the receiving plate concurrently with withdrawal of the needles to deposit the slice without damage thereto.

Since the needles are uniformly distributed over the entire surface of the drum, the latter can be driven in one sense only so that angular oscillation of the drum about its axis is not necessary.

For retraction and extension of the needles, I prefer to provide all of the needles along each generatrix of the cylindrical drum on a common bar which is disposed within the drum, the needles passing through respective holes in the drum shell. Spring means within the drum biases the bars inwardly. The bars are also formed with surfaces which extend radially inwardly but are inclined for engagement by a camming or wedging member having complementary surfaces and axially shiftable to move the bars radially.

When this control member is shiftable upwardly or downwardly (i.e. is axially reciprocated relative to the drum) the wedging surfaces of the bars and the member press the pins outwardly or allow them to be drawn inwardly by the springs respectively.

I have found it to be advantageous to rotate the drum by mounting it upon a shaft which is swingable about a horizontal axis and by providing the shaft with a bevel gear meshing with another bevel gear and a drum drive which are coaxial with this axis. The tilting movement whereby the axis of rotation of the drum is swung from its upright or take-up position to its depositing position can be effected by another drive.

To actuate the control member within the drum I provide a rod extending through the hollow shaft of the drum and terminating in a cam follower, such as a sliding head, roller or the like, which bears upon a cam surface. The cam surface is designed so that as the shaft and the drum are turned in the manner described, the rod is axially displaced to shift the control member and retract or extend the pins.

The rotation of the drum can be about 190° for each slice deposition. However, so that the transfer is coordinated precisely with the diameter of the slice, it has been found to be desirable to control the rotation of the drum in accordance with the actual diameter of the slice.

For example, a sensor of the photocell type can be provided to respond to the slice diameter and to switch an electric motor for displacement in proportion to the diameter. Preferably the electric motor driving the drum is a pulse motor.

If wurst of larger diameter is then cut, the angular displacement of the drum will be correspondingly increased and if wurst of smaller diameter is cut, the angular displacement will be correspondingly reduced. The result is that the location at which the slice is deposited will remain substantially constant.

With materials to be sliced which are not generally round peripherally, the length in the cutting direction is measured.

Various patterns of deposition of the slices on the receiving table can be generated, e.g. for convenience in packaging, when the shaft of the drum is telescopingly variable in length, thereby allowing the slices to be deposited at different distances from the tilting axis. A microprocessor-controlled programmer can be preprogrammed for the various patterns of slice deposition which may be desired so that, for example, the rotation of the drum, the effective length of its shaft and the coordinates of positioning of the receiving table in one of two axes (x axis or x and z axes) can be set for successive slices.

To vary the deposition pattern and ensure, for example, a complete coverage of the receiving table, I also find it advantageous to be able to vary the position of the tilting axis in a stepwise manner, preferably with program control. The stepped orientation of the tilting axis allows deposition of overlying slices in a slightly arcuate pattern without changing the length of the shaft and in a number of arcuate patterns if, after one arc is completed, the device repeats the deposition sequence after lengthening of the shaft. Similar results can, of course, be obtained by programmed displacement of the table.

In the event the pattern which is established is unsatisfactory, the table movement can provide any necessary correction.

BRIEF DESCRIPTION OF THE DRAWING

The above and other objects, features and advantages of the present invention will become more readily apparent from the following description, reference being made to the accompanying drawing in which:

FIG. 5 is a diagram showing a sensing circuit for the diameter of the slice;

FIG. 6 is a view similar to FIG. 5, but illustrating another embodiment thereof;

FIG. 7 is a fragmentary diagrammatic cross-sectional view of the telescoping shaft of the needle drum; and FIG. 8 is another diagram showing a drive scheme for the device of the invention.

SPECIFIC DESCRIPTION

Figure 1:
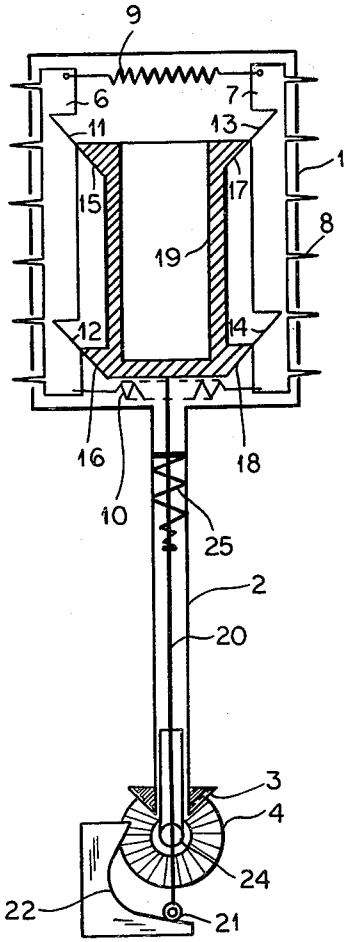
FIG. 1 is a diagrammatic axial cross section of a transfer device in accordance with the principles of the present invention, only two needle bars being shown.

In FIG. 1 I have shown a cylindrical drum 1 which is rotatable about its axis and is connected with a shaft 2 which is driven in a manner described subsequently in greater detail but which can be seen to involve the bevel gear transmission 3, 4 with the latter of these gears being driven by an electric motor 5 which is coaxial with the tilting axis of the shaft and drum.

An array of slice-engaging needles 8 is uniformly distributed over the entire cylindrical surface of the drum, the needles passing through respective holes in the drum shell. A multiplicity of needles can lie along each of a large number of generatrices and, in the embodiment illustrated, all of the needles along a given generatrix are affixed to a common needle bar 6 or 7, only two of which have been shown. In practice, corresponding to the number of rows of needles, an equivalent number of bars will be angularly equispaced apart within the drum 1.

To avoid confusion, only one pair of the diametrically opposite bars 6, 7 has been illustrated.

Spring means 9, 10 draws the ends of the bars 6, 7 inwardly. In the preferred, best mode and illustrated embodiment, each spring means is a coil spring of the tension type. However, the spring means can also be an elastic band and, in some cases, an annular spring may be connected to all of the needle bars to draw them inwardly against the output force of a control member to be described. When a ring is used, it is preferably composed of rubber.

Each of the needle bars 6, 7 is provided with inclined surfaces 11, 12 and 13, 14 near the opposite ends, these surfaces engaging control surfaces 15, 16 and 17, 18 of a control body 19 which, in its lower position shown in FIG. 1, wedges the needle bars outwardly so that the needles extend fully from the wall of the drum 1. In its upper position, the control member 19 permits the springs to retract the needles.

The control member 19 is provided with a rod 20 extending through the hollow shaft 2 and terminating in a cam follower roller 21 which rides upon a cam 22 serving to displace the rod 20 axially as the drum 1 and the shaft 2 tilt about the horizontal axis 24. The tilting drive has been represented at 23 in FIG. 2 and is shown in more detail elsewhere. In general this drive is an electromagnetic drive.

From FIG. 1 it will be apparent that as the drum of FIG. 1 tilts about the axis 24 in a clockwise sense, the rod 20 is pressed axially upwardly to shift the control member 19 into its upper position and allow the needles to retract, thereby depositing any slice which may have been impaled by the needles upon the receiving table.

When the drum 1 is rotated into its upright position, a spring 25 drives the rod 20 downwardly, overcoming the forces of springs 9 and 10 and allowing the needles 8 to extend fully.

Figure 3:
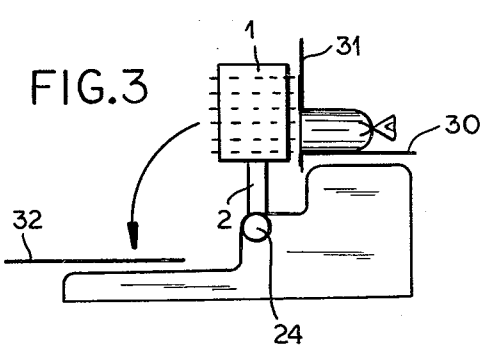
FIG. 3 is a diagrammatic front elevational view showing the operation of the slicing machine of the invention.
Figure 4:
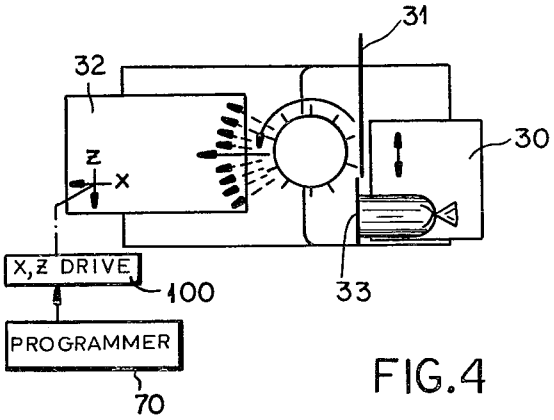
FIG. 4 is a plan view of the structure of FIG. 3.
Figure 2:
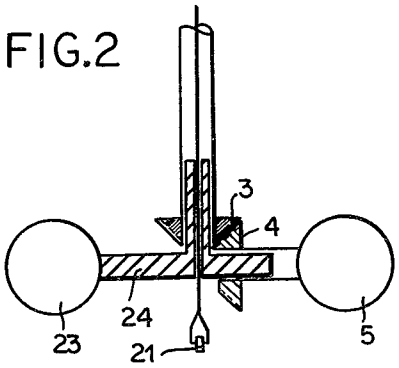
FIG. 2 is a diagram illustrating the drive for the device of FIG. 1 and corresponds to a section in a plane perpendicular to that of FIG. 1.

The device shown in FIGS. 1 and 2 is disposed directly adjacent the slicer as can be seen from FIGS. 3 and 4 so that when a comestible product, such as a length of wurst, is pressed against a stop plate 35 on the carriage 30 and is shifted as represented by the arrow in FIG. 4 back and forth across the edge of the rotary blade 31, slices are severed from the wurst.

In the upright position of the drum 1, with the needles extended, the peripheral speed of the drum is equal precisely to the linear speed of the carriage 30 which corresponds to the rate at which the slice emerges from between the blade 31 and plate 33. This synchronization can be insured by a mechanical coupling between the carriage and the drum or by a synchronized electric motor, but preferably is effected by means which will be described subsequently. The slice is synchronously picked up by the drum 1 and as it rotates about its axis, and the slice is fully severed from the wurst, the tilting movement (arrow in FIG. 3) can commence. The tilting movement brings the drum into a recumbent position while the cam 22 cooperates with the follower 21 to retract the needles and allow the slice to fall at a predetermined location on the receiving plate 32.

The tilting movement is coordinated with the rotation so that the slice on the drum is juxtaposed directly with the surface of the plate 32 as it drops therefrom.

To vary the location at which the slice is deposited upon the plate 32, means can be provided as shown diagrammatically at 100 to displace the plate 32 in x and z directions. Th drive 100 can be controlled by preprogrammed microprocessor programmer represented at 70.

The annular orientation of the axis 24 can be varied as shown in broken lines in FIG. 4 by means to be described subsequently enabling the deposit of the slices in an arcuate pattern. The drive 100 can be used for correction of the positions of the slices as necessary. The direction displacement can also be used for subsequent arcuate rows.

The rotary drive 5, the tilting drive 23 and the receiving table drive 100 can be coordinated through the microprocessor programmer to form any desired pattern including circular pattern deposition, e.g. with a round and rotatable receiving table.

To control the rotary drum 1 accurately, the stop plate 33 has at least one photocell for optical measurement of slice diameter or the displacement of the carriage table measured by a photocell system or a pulse generator connected directly to this carriage since the displacement of the latter is equal to the diameter. The motor 5 can be a pulse motor in the preferred embodiment.

In FIG. 5, for example, the carriage 30 is shown to shield the photocells 51 of the photocell array 50 on the plate 33 to a greater or lesser extent in accordance with the slice diameter. The photocell array 50 is connected at 52 to an amplifier 53 feeding a pulse shaper 54 whose output drives the pulse motor 5. Another diameter control is provided in FIG. 6 in which the carriage 30 has a rack 60 driving pinion 61 which is connected to a disk 62 forming a pulse generator as its contacts are wiped at 63 and transmit pulses to the shaper 65 through the amplifier 64. Here again the displacement of the carriage, being equal to the diameter of the slice, ensures synchronization of the motor 5.

FIG. 7 shows an arrangement whereby the shaft 2 can have a variable effective length. In this embodiment, the shaft has two telescoping parts **2*a* and 2*b* and the programmer 70 can drive a motor 2*d* which is mounted at 2*c* on the outer shaft part 2*a* so that its pinion 2*e* displaces a rack 2*f* formed on the inner shaft part 2*b***.

Naturally, variation in the length of the shaft 2 requires adjustment of the position of the cam 22 and this adjustment is provided by a hydraulic or electromagnetic cam shifter 72 also operated by the programmer 70. The arrangement of FIG. 7, of course, allows successive arcuate rows of slices to be deposited progressively further from the axis 24.

To allow angular orientation of the axis 24 (see FIG. 4), I provide the system of FIG. 8 in which shaft 2 is driven by motor 5 under the control of the programmer 70 through the bevel gears 3 and 4 previously mentioned, but the axis 24 is formed by a shaft 85 mounted in a fork 81. A fork 81 can be rotated by gearing 82, 83 via a pulse motor 84 controlled by the programmer 70, thereby angularly orienting the axis 24. The tilting movement by the electromagnetic device 23 controlled by the programmer 70 here uses a solenoid armature 86 connected by a link 87 to a crank arm 88 of shaft 85 which defines the axis 24. A diameter measuring means 71, e.g. of the type shown in FIG. 5 or FIG. 6, can provide an input to the microprocessor programmer 70.

In this embodiment, the rod 20 has an arm 89 which extends through a slot 90 in the shaft 2 and carries a cam follower 21 which rides upon the cam 22.

I claim:

1. In combination with a slicing machine having an upright stop plate, a carriage shiftable relative to said plate for a product to be sliced, a rotary blade spaced from said plate and cooperating with said carriage to form slices of said product which pass between said blade and said plate, and a receiving table adapted to receive said slices, a transfer device for taking up said slices from said plate and depositing said slices on said table, said transfer device comprising:

a rotary cylindrical drum formed with retractable slice-engaging needles;

means for juxtaposing said drum in an upright position with said blade whereby a slice served by said blade from said product is picked up by said drum;

means for swinging said drum into a position wherein said drum lies above said table whereby retraction of said needles deposits the picked-up slice on said table, said needles being provided in an array extending over the entire cylindrical surface of said drum, said needles being provided in rows along respective generatices of said drum, each of the needles along a respective generatrix being affixed to a common needle bar within said drum; and spring means urging said bars inwardly, and a control member within said drum axially shiftable to displace said bars inwardly and outwardly, thereby effecting retraction and extension of said needles on said drum, said drum being provided with a shaft tiltable about a horizontal axis and rotatable about the axis of said drum for rotation of said drum, said drum being hollow, said member being provided with a rod extending axially along said shaft and terminating in a cam follower, said device comprising a cam engaging said cam follower and effective upon tilting of said drum and said shaft about said horizontal axis for axially displacing said member relative to said drum.

2. The transfer device defined in claim 1, further comprising photocell means for measuring the diameter of the slice severed from said product by said blade and means connected to said photocell means for correspondingly rotating said drum.

3. The transfer device defined in claim 2 wherein the last-mentioned means is a pulse-controlled electric stepping motor.

4. The transfer device defined in claim 1 wherein said shaft is telescopingly elongatable whereby said drum can deposit slices at various locations on said table.

5. The transfer device defined in claim 1, further comprising means for varying the orientation of said horizontal axis.

6. The transfer device defined in claim 5, wherein the last-mentioned means includes a programmer.

7. The transfer device defined in claim 1, claim 2, claim 3, or claim 4 wherein each of said bars is provided with a pair of inclined surfaces and said member has complementary inclined surfces engaging said surfaces of said bar.

* * * * *